United States Patent [19]

Yoshida

[11] 4,304,030

[45] Dec. 8, 1981

[54] SLIDE FASTENER STRINGER

[75] Inventor: Hiroshi Yoshida, Kurobe, Japan

[73] Assignee: Yoshida Kogyo K.K., Tokyo, Japan

[21] Appl. No.: 86,992

[22] Filed: Oct. 22, 1979

[30] Foreign Application Priority Data

Nov. 9, 1978 [JP] Japan ..... 53-138201

[51] Int. Cl.[3] ..... A44B 19/40

[52] U.S. Cl. ..... 24/205.16 C; 139/384 B

[58] Field of Search ..... 24/205.16 R, 205.16 C, 24/205.13 C; 139/384 B

[56] References Cited

U.S. PATENT DOCUMENTS

| | | | |
|---|---|---|---|
| 3,057,031 | 10/1962 | Wahl | 24/205.16 C |
| 3,058,188 | 10/1962 | Yoshida | 24/205.13 C X |
| 3,135,036 | 6/1964 | Burbank | 24/205.13 C X |
| 3,454,052 | 7/1969 | Burbank | 24/205.16 R X |
| 3,822,444 | 7/1974 | Johns | 24/205.13 C |
| 3,874,036 | 4/1975 | Yoshikawa | 24/205.16 C X |
| 3,961,652 | 6/1976 | Hasuda | 24/205.16 C X |
| 4,133,084 | 1/1979 | Yoshida | 24/205.16 C |
| 4,134,184 | 1/1979 | Motta | 24/205.16 C |
| 4,215,729 | 8/1980 | Ofusa | 24/205.16 C X |
| 4,216,805 | 8/1980 | Akashi | 24/205.16 C X |

*Primary Examiner*—Roy D. Frazier
*Assistant Examiner*—Peter A. Aschenbrenner
*Attorney, Agent, or Firm*—Bucknam and Archer

[57] ABSTRACT

A slide fastener stringer has a woven stringer tape including a web and a tube extending along one longitudinal edge of the web, and a row of coiled coupling elements woven into the tube. The coupling elements comprise a plurality of coupling heads and a plurality of connecting portions each interconnecting two adjacent coupling heads and disposed in the tube, there being a core extending longitudinally through the coupling elements. A pair of stuffer cords extend longitudinally through the tube and are held against the connecting portions of the coupling elements. Two of the warp threads in the tube are disposed on the respective stuffer cords, serving as corners for guiding a slide fastener slider therealong. Other two of the warp threads in the tube are of less diameter than the corner warp threads at portions of the stuffer cords which are remote from the connecting portions of the coupling elements.

4 Claims, 7 Drawing Figures

SLIDE FASTENER STRINGER

BACKGROUND OF THE INVENTION

1. Field of the Invention

The present invention relates to a slide fastener stringer; and more particularly to a woven slide fastener stringer having a row of coupling elements woven into a longitudinal edge of a stringer tape.

2. Prior Art

There have been proposed many slide fastener stringers including a woven stringer tape having a woven tube extending along one longitudinal edge of the tape, and a row of coupling elements each in the form of a filamentary coil or convolution with a core therein, woven into the tube. One inherent problem with such slide fastener stringers is that the weft thread in the woven tube tends to be worn away by repeated frictional contact with the slider under conditions in which the fastener stringers are transversely stretched with a lateral pull.

An attempt to solve such a problem would be to use sliders so shaped as to reduce friction in its sliding engagement with the weft thread in the woven tube. For example, a slider having a widened spacing between upper and lower guide flanges, or having rounded or tapered inside corners on the guide flanges would be effective to prevent the weft thread from being rapidly abraded by repeated contact with such slider guide flanges. The proposed sliders, however, could endanger their ability to be smoothly or steadily guided along a slide fastener chain.

SUMMARY OF THE INVENTION

According to the present invention, a pair of stuffer cords extend longitudinally through a tubular pocket in a woven tube extending along one longitudinal edge of a woven stringer tape, and are held against the connecting portions or heels of a row of coiled coupling elements or convolutions woven into the woven tube. The coupling elements or convolutions are stably supported by the stuffer cords and a core extending through the convolutions, the stuffer cords and the core jointly sandwiching the connecting portions therebetween in the woven tube. A pair of warp threads in the woven tube are disposed respectively on the stuffer cords at upper and lower portions of the woven tube which are remote from the coupling element connecting portions, the pair of warp threads serving as a pair of respective corners for guiding a slide fastener slider. Another pair of warp threads in the woven tube that are of smaller diameter than the corner warp threads are disposed between the corner warp threads to provide a recess behind the stuffer cords, in which recess the small-diameter warp threads are disposed in abutment against the stuffer cords.

It is an object of the present invention to provide a woven slide fastener stringer including a woven tube having weft thread portions that are less liable to get worn away by repeated frictional engagement with a slide fastener slider under conditions in which the fastener stringers are transversely pulled.

Another object of the present invention is to provide a woven slide fastener stringer including a woven tube supporting a row of coiled coupling elements woven therein and having a pair of guide corners for effectively guiding a slide fastener slider therealong.

Still another object of the present invention is to provide a woven slide fastener stringer including a row of coupling elements stably supported in a woven tube extending along a longitudinal edge of the stringer tape.

These and other objects and advantages of the present invention will become apparent from the following description when taken in conjunction with the accompanying drawings.

DETAILED DESCRIPTION

Figure 1:
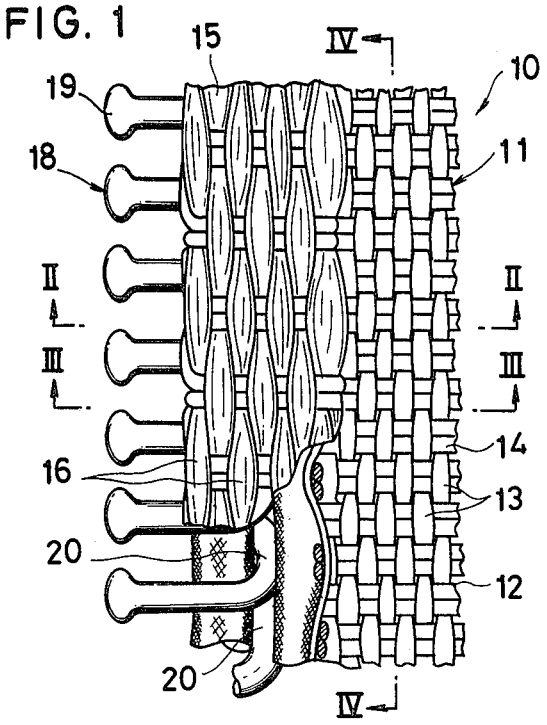
FIG. 1 is a fragmentary plan view, partly cut away, of a slide fastener stringer according to the present invention.

FIG. 1 shows a woven slide fastener stringer 10 constructed in accordance with the present invention, the slide fastener stringer 10 comprising a stringer tape 11 including a web 12 woven of a plurality of warp threads 13 and a weft thread 14 interwoven therewith in double picks. The stringer tape 11 also includes an elongate tube 15 at one of its longitudinal edges, woven basically of a pair of spaced upper and lower groups of warp threads 16,17 (FIG. 2) interwoven with double picks of the weft thread 14.

As shown in FIG. 1, a row of coupling elements or convolutions 18 in the form of a continuous filamentary coil extends along and is woven into the woven tube 15 by the weft thread 14. The weft thread 14 is placed in two double picks for each distance between two adjacent coupling elements 18. Each of the coupling elements 18 includes a coupling head 19 and a connecting portion 20 interconnecting two adjacent coupling heads 19, the connecting portion 20 having an arcuate, rounded surface disposed in a tubular pocket 21 in the woven tube 15.

A core 22 in the form of a textile cord extends longitudinally through the coiled coupling elements 18 and is held by the weft thread 14 against the connecting portions 20 in the interior of the coiled coupling elements 18.

Figure 2:
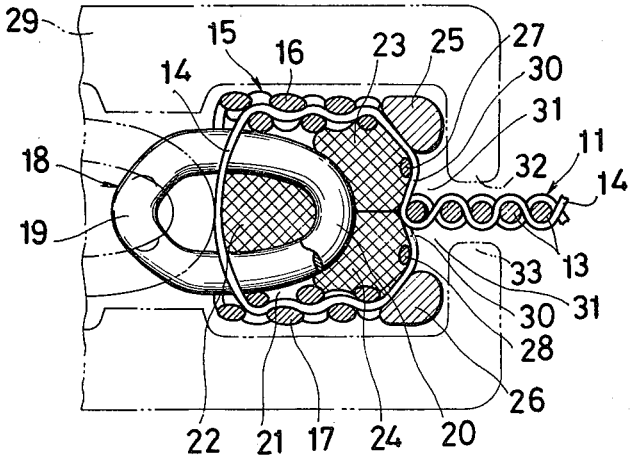
FIG. 2 is a cross-sectional view taken along line II—II of FIG. 1.
Figure 3:
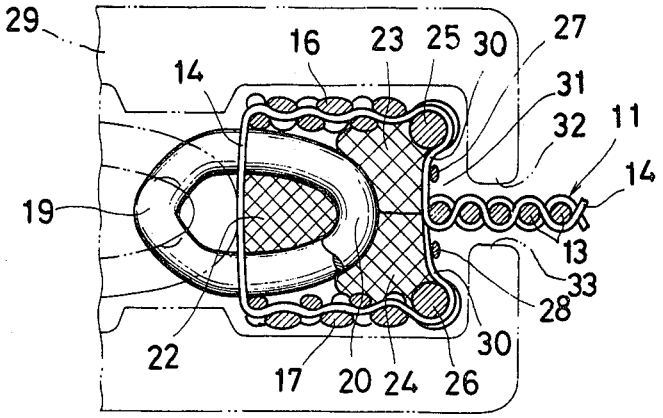
FIG. 3 is a cross-sectional view taken along line III—III of FIG. 1.

As best illustrated in FIGS. 2 and 3, a pair of upper and lower stuffer cords 23,24 extend longitudinally through the tubular pocket 21 and are held against the connecting portions 20 at the exterior of the coupling elements 18. The tubular pocket 21 is substantially filled up with the connecting portions 20, the core 22, and the pair of stuffer cords 23,24, with the stuffer cords 23,24 having surfaces which are jointly deformed in conformity with the arcuate, round surfaces of the connecting portions 20. The coupling elements 18 are stably supported by the stuffer cords 23,24 and the core 22 which jointly sandwich the connecting portions 20 in the woven tube 15.

A pair of upper and lower corner warp threads 25,26 which are interwoven with the weft thread 14 and constitute part of the woven tube 15 are disposed respectively on the upper and lower stuffer cords 23,24 at upper and lower portions of the woven tube 15 which are adjacent to the respective upper and lower groups of warp threads 16,17 and remote from the connecting portions 20. The warp threads 25,26 are of larger diameter than the warp threads 16,17 in the woven tube 15. The upper and lower corner warp threads 25,26 serve as a pair of respective guide corners for guiding a slide fastener slider 29 therealong.

A pair of upper and lower warp threads 27,28 which also are interwoven with the weft thread 14 and constitute part of the woven tube 15 are of smaller diameter than the warp threads 25,26 and are interposed between the warp threads 25,26 on portions of the stuffer cords 23,24 which are remote from the connecting portions 20.

The weft thread 14 has portions 30 interwoven with the warp threads 27,28 and normally held against the stuffer cords 23,24 by the corner warp threads 25,26.

The corner warp threads 25,26 that have a larger diameter than the warp threads 27,28 jointly provide a recess 31 therebetween opening away from the connecting portions 20 toward the tape web 12, in which recess 31 the portions 30 of the weft thread 14 are normally disposed out of contact with a pair of guide flanges 32,33 of the slider 29.

Figure 5:
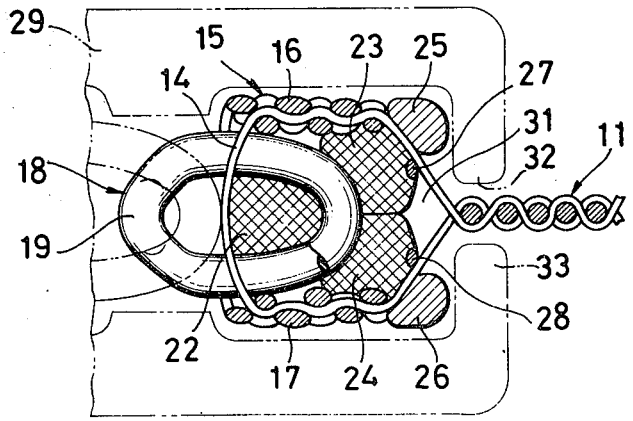
FIG. 5 corresponds to FIG. 2, showing the slide fastener stringer which is transversely pulled.

The woven tube 15, being filled up with the stuffer cords 23,24, the connecting portions 20 of the coupling elements 18, and the core 22, is tight and compact, and is prevented from collapsing under a force tending to stretch the fastener stringer 10 transversely, resulting in a tendency of the weft thread portions 30 to cling on to the stuffer cords 23,24. The portions 30 of the weft thread 14 are normally held against the stuffer cords 23,24, and even when subjected to a lateral pull, are held free from contact with the guide flanges 32,33 of the slider 29 (FIG. 5).

Figure 4:
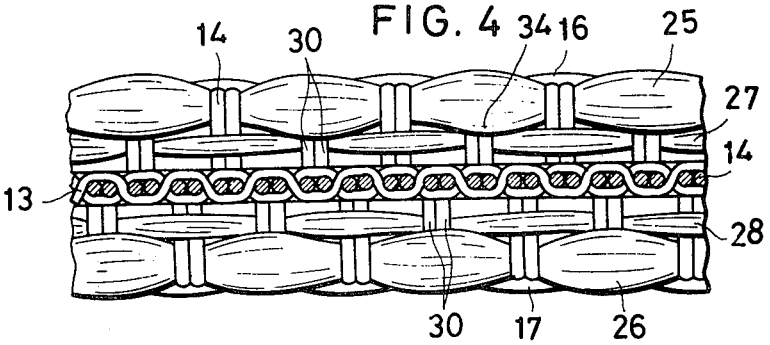
FIG. 4 is a cross-sectional view taken along line IV—IV of FIG. 1.

It has now been found that where the warp threads 16,17 comprise yarns of 300-denier, the corner warp threads 25,26 yarns of 600-denier, and the warp threads 27,28 yarns of 150-denier, the weft thread portions 30 (FIG. 4) are effectively anchored on the stuffer cords 23,24 by bulging portions 34 of the corner warp threads 25,26, and are held back in the recess 31 out of contact with the slider guide flanges 32,33.

The slider 29 is positively guided for smooth sliding movement by the corner warp threads 25,26 without the guide flanges 32,33 interfering with the weft thread portions 30 and the warp threads 27,28, which are disposed in the recess 31 between the corner warp threads 25,26.

Even when the fastener stringers 10,10 are transversely stretched apart with a lateral pull, the weft thread portions 30 are prevented from striking the slider guide flanges 32,33 for the reason mentioned above and because the corner warp threads 25,26 and warp threads 27,28 distribute such lateral pull longitudinally of the woven tube 15 and tend to hold the weft thread portions 30 back into the recess 31. Therefore, the weft thread portions 30 engage the slider guide flanges 32,33 only with a minimum of friction when the weft thread portions 30 have been forced out of the recess 31 under a severe lateral pull, with the result that the weft thread portions 30 are prevented from being rapidly worn away by frictional contact with the slider 29.

Figure 6:
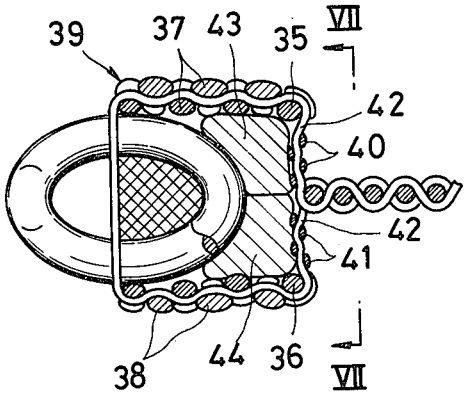
FIG. 6 is a cross-sectional view of a slide fastener stringer according to another embodiment of the present invention.
Figure 7:
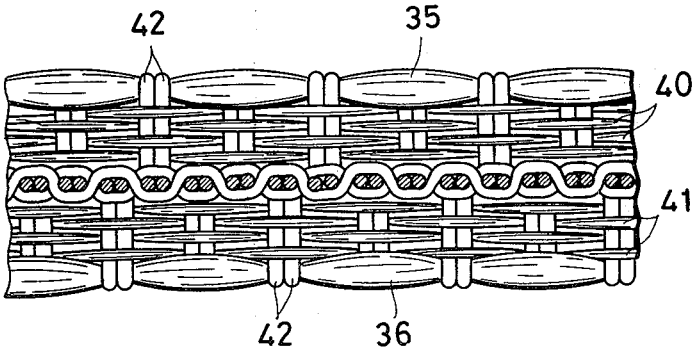
FIG. 7 is a cross-sectional view taken along line VII—VII of FIG. 6.

A slide fastener stringer according to another embodiment shown in FIGS. 6 and 7 differs from the first embodiment in that a pair of upper and lower warp threads 25,26 that serve as a pair of respective corners for guiding a slide fastener slider are of substantially the same diameter as a pair of upper and lower groups of warp threads 37,38 which form a woven tube 39. A pair of upper and lower groups of warp threads 40,41 (eight in total number) are of less diameter than the corner warp threads 35,36 and are interwoven with weft thread portions 42.

It has been found that where the warp threads 35,36, 37,38 comprise yarns of 300-denier, and the warp threads 40,41 yarns of 100-denier, the weft thread portions 42 are covered more densely by the warp threads 40,41 to provide a compact structure behind a pair of stuffer cords 43,44 for protection against frictional contact with a slider.

Although preferred embodiments of the present invention have been shown and described in detail, it should be understood that many minor changes and modifications may be made therein without departing from the scope of the appended claims.

What I claim is:

1. A slide fastener stringer comprising:

(a) a stringer tape woven of warp threads and a weft thread, and including a web and a tube extending along one longitudinal edge of said web and having a tubular pocket;

(b) a row of coupling elements in the form of a continuous filamentary coil extending along and woven into said tube, said coupling elements including a plurality of coupling heads and a plurality of connecting portions each interconnecting two adjacent coupling heads and disposed in said tubular pocket;

(c) a core extending longitudinally through said coupling elements and held against said connecting portions in the interior of said coupling elements; and (d) a pair of stuffer cords extending longitudinally through said tubular pocket and held against said connecting portions at the exterior of said coupling elements, two of the warp threads in said tube being disposed respectively on said stuffer cords remotely from said connecting portions and serving as a pair of respective corners for guiding a slide fastener slider, and at least two of the warp threads in said tube being of smaller diameter than the corner warp threads and disposed between the corner warp threads on portions of said stuffer cords which are remote from said connecting portions, thereby providing a recess disposed between said corner warp threads and opening away from said connecting portions, said weft thread having portions interwoven with said smaller-diameter warp threads and held against said stuffer cords in said recess.

2. A slide fastener stringer according to claim 1, said tubular pocket being substantially filled up jointly with said connecting portions, said core and said stuffer cords, whereby said tube is tight and compact.

3. A slide fastener stringer according to claim 1, said corner warp threads comprising yarns of 600-denier, and said smaller-diameter warp threads being provided in a pair and comprising yarns of 150-denier.

4. A slide fastener stringer according to claim 1, said corner warp threads comprising yarns of 300-denier, and said smaller-diameter warp threads being provided in eight in number and comprising yarns of 100- to 150-denier.

* * * * *